US009393599B2

(12) United States Patent
Seippel

(10) Patent No.: US 9,393,599 B2
(45) Date of Patent: Jul. 19, 2016

(54) METHOD FOR CLEANING HVAC SYSTEM AND METHOD AND SYSTEM FOR VERIFYING CLEANING EFFECTIVENESS

(75) Inventor: Jeff Seippel, Novi, MI (US)

(73) Assignee: Greenair Process, LLC, Novi, MI (US)

( * ) Notice: Subject to any disclaimer, the term of this patent is extended or adjusted under 35 U.S.C. 154(b) by 429 days.

(21) Appl. No.: 12/824,848

(22) Filed: Jun. 28, 2010

(65) Prior Publication Data

US 2010/0326470 A1 Dec. 30, 2010

Related U.S. Application Data

(60) Provisional application No. 61/220,818, filed on Jun. 26, 2009.

(51) Int. Cl.

| | |
|---|---|
| ***B08B 3/00*** | (2006.01) |
| ***B08B 3/02*** | (2006.01) |
| ***F25B 47/00*** | (2006.01) |
| ***F28D 1/047*** | (2006.01) |
| ***F28F 1/32*** | (2006.01) |
| ***F28G 9/00*** | (2006.01) |
| ***F28G 15/00*** | (2006.01) |

(52) U.S. Cl.

CPC . *B08B 3/02* (2013.01); *F25B 47/00* (2013.01); *F28D 1/0477* (2013.01); *F28F 1/32* (2013.01); *F28G 9/00* (2013.01); *F28G 15/00* (2013.01); *F28G 15/003* (2013.01); *B08B 2230/01* (2013.01); *F24F 2221/22* (2013.01)

(58) Field of Classification Search

CPC ..... B08B 3/02; B08B 9/023; F24F 2221/22; F82G 9/00

USPC ..... 134/22.11, 22.13, 22.15, 14, 22.18, 134/22.1, 25.1, 22.12

See application file for complete search history.

(56) References Cited

U.S. PATENT DOCUMENTS

| | | | | |
|---|---|---|---|---|
| 4,181,536 | A * | 1/1980 | Keyworth et al. | 134/2 |
| 5,401,311 | A * | 3/1995 | Freese et al. | 134/2 |
| 5,423,917 | A * | 6/1995 | Garcia, Jr. | 134/1 |
| 5,509,972 | A * | 4/1996 | Akazawa et al. | 134/26 |
| 2003/0024552 | A1 * | 2/2003 | Watanabe | B08B 3/02 134/26 |
| 2007/0281876 | A1 * | 12/2007 | Garner et al. | 510/245 |
| 2008/0105280 | A1 * | 5/2008 | Herdt et al. | 134/22.13 |
| 2011/0209730 | A1 * | 9/2011 | Varrin, Jr. | F22B 37/002 134/22.19 |

FOREIGN PATENT DOCUMENTS

| | | | |
|---|---|---|---|
| JP | 2001021289 | A | 1/2001 |
| JP | 2009030932 | A | 2/2009 |
| KR | 100249062 | B1 | 4/2000 |

OTHER PUBLICATIONS

BBJ Products, PDS Sheet—Power Coil Clean. <http://www.bbjenviro.com/products_powercoil_pds.asp> Mar. 9, 2005.*

* cited by examiner

*Primary Examiner* — Michael Kornakov
*Assistant Examiner* — Katelyn Whatley
(74) *Attorney, Agent, or Firm* — The Dobrusin Law Firm, P.C.; Daniel P. Aleksynas

(57) ABSTRACT

A method of cleaning and a system and method of determining the effectiveness of a cleaning process for an HVAC system including a heat exchanger having a coil matrix. The coil matrix includes a plurality of rows of heat exchanging coils in which each adjacent row of coils is offset. The plurality of rows define channels extending through the coil matrix between an upstream side and a downstream side. The heat exchanger cleaning method includes applying a cleaning solution and a wet steam mixture directed into the channels. The effectiveness of the cleaning method is determine by a system and method which measures various operating parameters at the inlet side and outlet side of the heat exchanger both before and after the cleaning process. The system and method calculate a SEER rating using the total amount of heat removed by the HVAC system and the total power usage of the HVAC system.

14 Claims, 14 Drawing Sheets

METHOD FOR CLEANING HVAC SYSTEM AND METHOD AND SYSTEM FOR VERIFYING CLEANING EFFECTIVENESS

CROSS-REFERENCE TO RELATED APPLICATIONS

This application claims priority of U.S. Provisional Patent Application Ser. No. 61/220,818 filed Jun. 26, 2009, which is incorporated herein by reference.

FIELD OF THE INVENTION

The present invention relates to the cleaning of HVAC systems and, more particularly, to a method of cleaning and a system and method of verifying the effectiveness of the cleaning.

BACKGROUND OF THE INVENTION

Modern HVAC systems operate by circulating a refrigerant through a system in which heat is transferred between the conditioned space and the refrigerant. As seen in FIG. 1, the HVAC system includes a compressor, a heat exchanger (condenser), turbine/expansion valve, and through a heat exchanger (evaporator). During operation the refrigerant cycles through various components of the HVAC system changing phase and, consequently, undergoing a temperature change. As the refrigerant flows through the compressor, the refrigerant is typically compressed from a two phase liquid vapor mixture into a saturated vapor. The compression of the refrigerant increases the temperature and pressure of the refrigerant. As the refrigerant passes from the compressor to the condenser, it flows through the condenser coils allowing heat transfer to the ambient air which is passed through the coils by a condenser fan. Due to the heat transfer, the refrigerant changes phase from a saturated vapor to a saturated liquid. The refrigerant then flows through a turbine or expansion valve expanding adiabatically, decreasing the temperature and also the pressure. The cooled refrigerant then flows through the coils of a heat evaporator where heat is transferred from air blown through the evaporator by an evaporator blower. The cooled air is then circulated throughout the conditioned space. As the refrigerant passes through the evaporator, it undergoes a phase change from a liquid to a vapor as a result of the heat transfer from the directed air into the refrigerant.

HVAC systems utilized in commercial or large scale industrial settings utilize heat exchanges (condensers and evaporators) having high density coil matrixes having a thickness of 8 to 12 inches. The high density coil matrixes often include a plurality of heat exchanging coils extending 10 to 12 feet perpendicular to the air flow and stacked 10 to 12 feet in height. In order to provide adequate heat transfer between the coils and the air, each adjacent row of coils is offset allowing greater distance between each of the coils.

The heat exchanging coils are extremely susceptible to becoming fouled and compacted with a variety of airborne contaminants. As these coils become increasingly congested with airborne particulate, biological growth, and other debris, air flow through the coils becomes compromised. Further, the contaminants act as an insulation on the coil surface which prohibits the transfer of heat from the coil surface to the air in the condenser or the transfer of heat from the air to the coil surface in the evaporator.

The previously known coil matrix techniques have utilized caustic chemicals in conjunction with a high pressure power washer. However, the caustic chemicals corrode the coil matrix causing etching and pitting on the coil surface thereby degrading thermal performance. The corrosion of the coil surface often causes the coils to foul at an accelerated rate thereby aggravating the problem.

In addition, the previously known power washing techniques merely provide a cosmetic cleaning of the visible surface of the coil matrix as the application of high pressure water at an angle perpendicular to the coil surface cannot effectively clean beyond the outer coils due to the offset positioning of the adjacent rows of coils. The previously known coil matrix cleaning techniques are highly disadvantageous as the majority of the inner coils are not thoroughly cleaned. Further, the cosmetic cleaning of the visible surface of the coil matrix gives the appearance of a thoroughly cleaned coil matrix to both a technician and consumer who often attribute the decrease in efficiency in the HVAC system to other factors as the matrix coil appears to be contaminant free.

Thus there exists a need for a cleaning method for a heat exchanger of an HVAC system which thoroughly cleans the entire coil matrix by penetrating beyond the outer layer of visible coils and into the inner majority of the coil matrix. Further, there exists a need for a method and system to verify the effectiveness of cleaning the coil matrix and to provide both the technician and consumer evidence in the form of the changing operating efficiency before and after the cleaning process.

SUMMARY OF THE INVENTION

The present invention provides a cleaning method and a system and method for verifying the effectiveness of the HVAC cleaning method which overcomes the above-mentioned disadvantages of the previously known cleaning methods.

According to one aspect of the invention, a method for cleaning a heat exchanger of an HVAC system is provided. The heat exchanger includes a coil matrix having a plurality of rows of heat exchanging coils. The plurality of rows define channels extending through the coil matrix between an upstream side and a downstream side. The heat exchanger cleaning method includes applying a layer of noncorrosive, environmentally friendly cleaning solution having ammonium bifluoride directly onto the plurality of channels. The cleaning solution is allowed to set on the plurality of heat exchanging coils for a predetermined time in order to penetrate the contaminant formed on the coil surface. A pressurized and heated wet steam mixture of the noncorrosive and environmentally friendly cleaning solution and water is directed between each of the plurality of channels so as to penetrate the coil matrix through the plurality of rows between the inlet side and the outlet side.

According to another aspect of the invention, a method for verifying the effectiveness of the cleaning of a HVAC system heat exchanger includes measuring pre-cleaning operating condition at the inlet and outlet side of the heat exchanger. The method determines the total amount of heat removed by the heat exchanger prior to cleaning. The total power used by the HVAC system in order to remove the heat is then determined. A pre-cleaning SEER rating is then calculated using the determined total amount of heat removed and the total power usage. The coil matrix of the heat exchanger is then cleaned. The conditions are then measured post cleaning at the inlet and outlet side of the heat exchanger. The total heat removed by the heat exchanger post cleaning is determined, and the total power usage by the HVAC system in order to remove the total amount of heat is determined. A post cleaning SEER rating is then calculated using the determined total amount of heat removed post cleaning and the determined total power usage post cleaning. The pre-cleaning SEER rating is then compared to the post cleaning SEER rating to determine the effectiveness of cleaning the heat exchanger.

According to a further aspect of the invention, a system for determining the effectiveness of cleaning the heat exchanger of an HVAC system is provided. The system includes a power sensor operable to detect the total power usage of the HVAC system. An inlet sensor is positioned on the inlet side of the heat exchanger to determine various conditions. An outlet sensor is positioned on the outlet side of the heat exchanger to detect various outlet conditions. The system further includes a computer processing unit having a database operable to receive the detected power usage, the detected inlet atmospheric conditions, and the outlet atmospheric conditions. A pre-cleaning measurement of the detected inlet conditions and the outlet conditions and a post cleaning measurement of the detected inlet and outlet conditions are stored in the database. The computer processing unit compares the pre-cleaning measurements and the post cleaning measurements to determine the effectiveness of cleaning the heat exchanger.

The system further includes a power sensor operable to detect the total power usage of the HVAC system. The computer processing unit determines a pre-cleaning total amount of heat removed by the HVAC system using the pre-cleaning measurements and calculates a pre-cleaning SEER rating using said pre-cleaning total amount of heat removed and the total power usage of the HVAC system. The computer processing unit determines a post cleaning total amount of heat removed by the HVAC system using the post cleaning measurements and calculates a post cleaning SEER rating using said post cleaning total amount of heat removed and the total power usage of the HVAC system. The computer processing unit compares the pre-cleaning SEER rating and the post cleaning SEER rating to determine the effectiveness of cleaning the heat exchanger.

BRIEF DESCRIPTION OF THE DRAWINGS

A better understanding of the present invention will be had upon reference to the following detailed description when read in conjunction with the accompanying drawings wherein like reference characters refer to like parts throughout the several views and in which.

DETAILED DESCRIPTION OF THE INVENTION

The present invention has utility as a cleaning method for use on a heat exchanger having a high density coil matrix, and a system and method for verifying the effectiveness of the cleaning of a heat exchanger. By using a cleaning method which penetrates through the entire high density coil matrix, a thorough cleaning of the heat exchanger can be provided. Further, the use of the system and method for verifying effectiveness of the cleaning provides both a technician and consumer verifiable proof that the cleaning method provides advantages directly attributable to the cleaning method and not merely a cosmetic cleaning of the surface of the heat exchanger.

Figure 1:
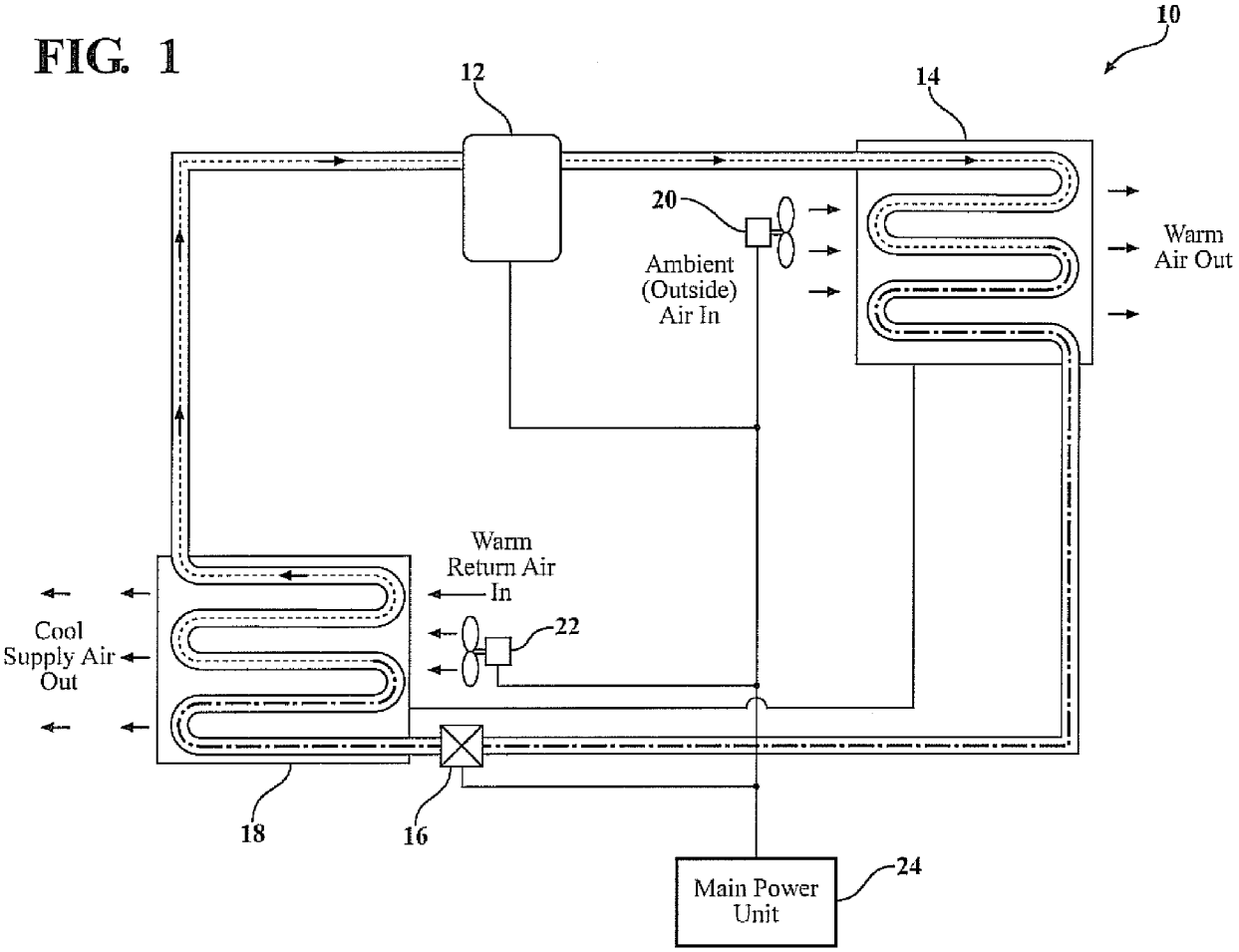
FIG. 1 Prior Art
FIG. 1 is a schematic illustrating a typical HVAC system.

With reference to FIG. 1, a typical HVAC system is generally indicated at 10. The HVAC system includes a compressor 12, a heat exchanger in the form of a condenser 14, an expander 16, in the form of either a turbine or expansion valve, and a second heat exchanger in the form of an evaporator 18. A condenser fan 20 is positioned adjacent the condenser 14 so as to force outside (ambient) air through the condenser 14 to transfer heat from the refrigerant flowing to the air. The heated air is then directed away from the conditioning space such as through an exhaust vent exiting into the environment. An evaporator fan 22 is similarly positioned adjacent the evaporator 18 so as to force air through the evaporator 18 to transfer heat from the air into the evaporator 18. The cooled air is then directed through a supply duct to the conditioned space such as a building interior. It is appreciated, of course, that both the condenser fan 20 and the evaporator fan 22 are alternatively in the form of a suction blower which forces air through the condenser 14 or the evaporator 18, respectively, through the use of a vacuum.

A main power unit 24 is connected to the compressor, the condenser 14, the expander 16, the evaporator 18, the condenser fan 22, and the evaporator fan 22. The main power unit 24 is operatively connected to the power grid or in the alternative is a self-generating power unit, and which supplies electrical power to all of the various electronic devices of the HVAC system 10.

Figure 2:
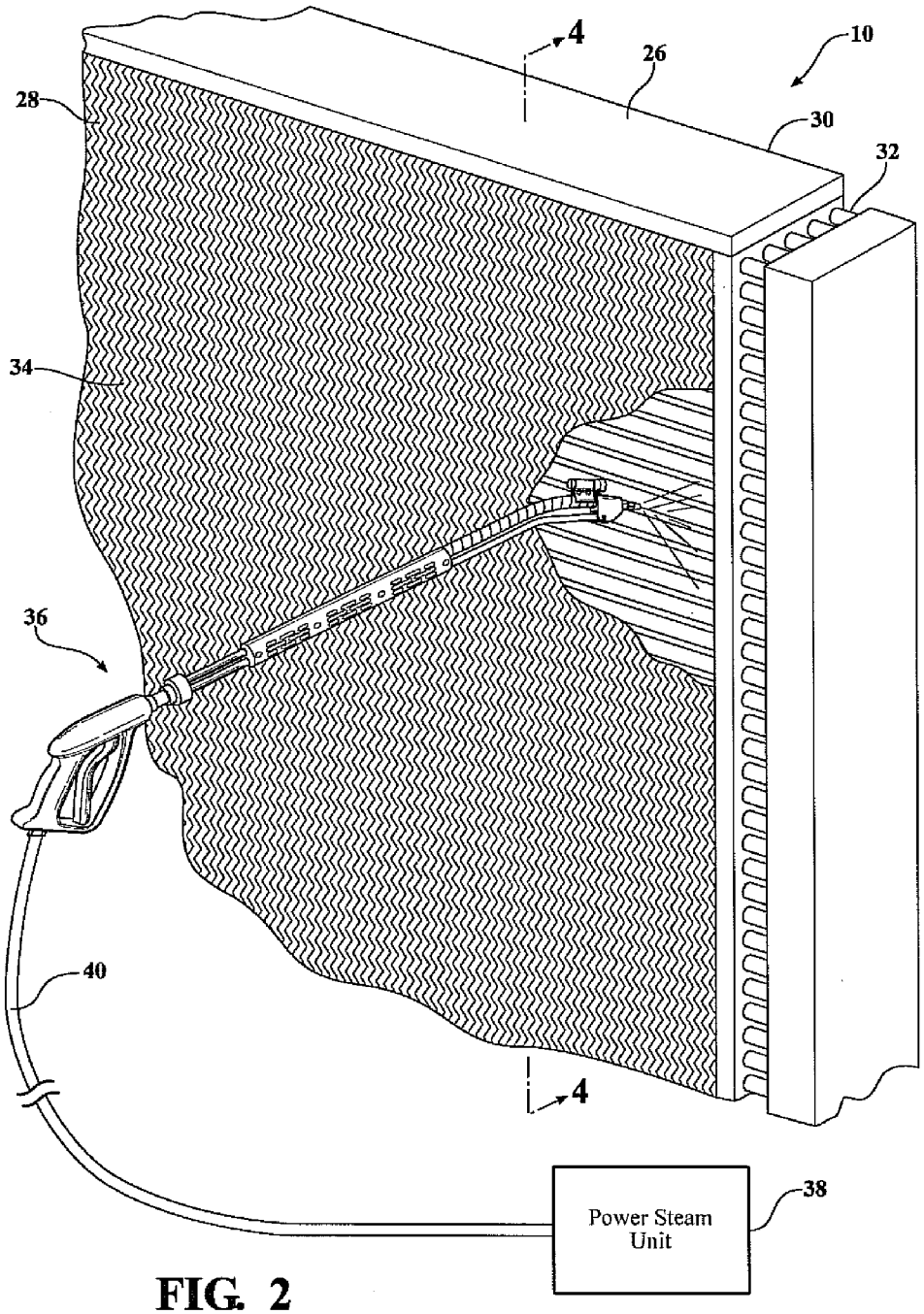
FIG. 2 is a partial perspective view illustrating a heat exchanger having a high density coil matrix.

Referring now to FIG. 2, a heat exchanger having a high density coil matrix is generally indicated at 26. It is appreciated, of course, that the heat exchanger 26 is either the condenser 14 or the evaporator 18 as the inventive cleaning method is applicable to a heat exchanger regardless of the direction of heat transfer between the air and the coils. Further, the inventive cleaning method is applicable on various types of heat exchangers including small scale commercial HVAC systems and residential air conditioning units.

The heat exchanger 26 includes an inlet side 28 and an opposite outlet side 30. The inlet side 28 is the face of the heat exchanger 26 in which air enters and, similarly, the outlet side 30 is the face of the heat exchanger 26 in which air exits. The heat exchanger 26 includes a plurality of rows of heat exchanging coils 32 substantially extending the entire width of the heat exchanger 26. The heat exchanging coils 32 extend in a longitudinal direction which is generally perpendicular to the flow of air through the heat exchanger 26. A plurality of heat dispensing fins 34 are suspended within the heat exchanger 26 and extend in a direction generally parallel to the direction of air flow through the heat exchanger 26. The heat dispensing fins 34 are positioned having a density of 10-18 fins per square inch.

A wand 36 used to clean the coils 32 is connected to a power steam unit 38 by a supply hose 40. The power steam unit 38 is capable of heating and pressurizing a mixture of water and cleaning solution into a wet steam having a mixture of liquid and steam at the saturation temperature. The power steam unit 38 is capable of pressurizing the mixture to at least 1300 pounds per square inch and heating the mixture to at least a temperature of 250 degrees. A suitable power steam unit 38 is sold under the commercial name of Ultra 1300 by the Therma-Kleen Commercial corporation.

Figure 3:
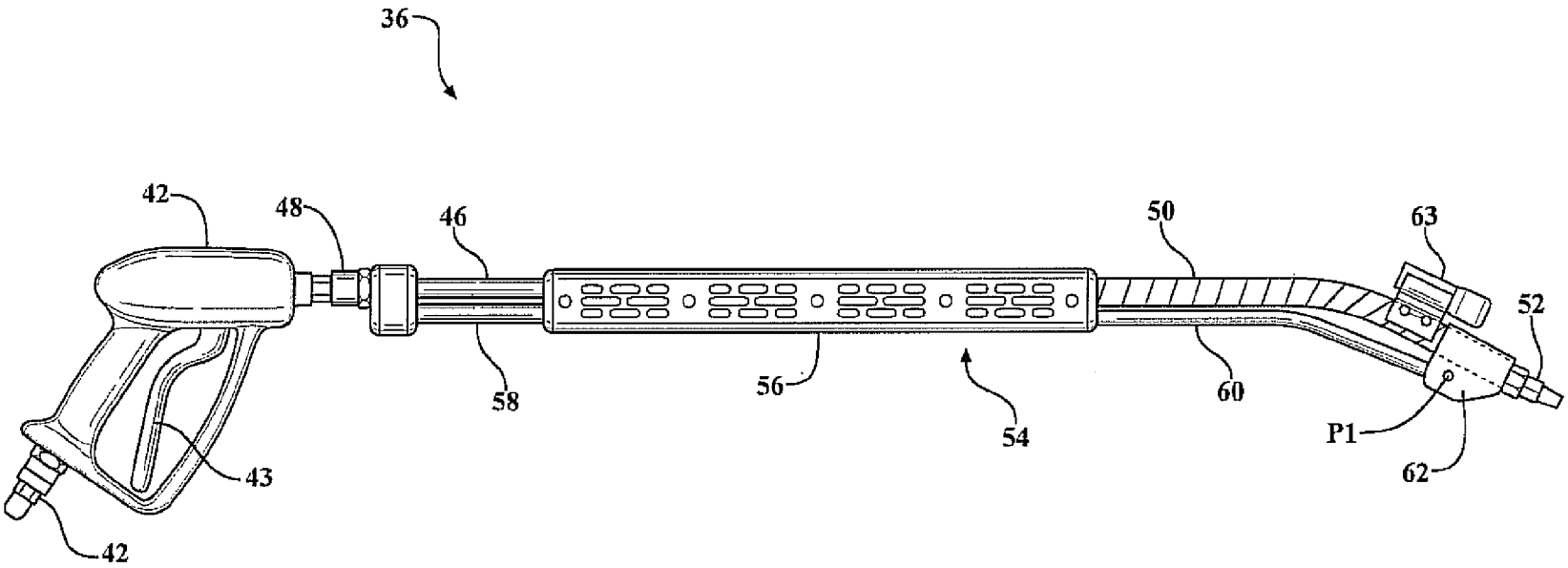
FIG. 3 is a side view illustrating a wand for use in the cleaning method.

With reference to FIG. 3, the wand 36 includes a trigger unit 42 having a hookup 44 which connects to the power steam unit 38 through the supply hose 40. The trigger unit 42 includes an actuator 43 for selectively discharging the wet steam mixture. A conduit 46 is connected to the trigger unit 42 by a rotational joint 48 allowing the conduit 46 to spin 360 degrees. A flexible hose 50 is attached to a terminal end of the conduit 46, and a nozzle 52, through which the wet steam mixture discharges, is attached to the end of the flexible hose 50.

An adjuster mechanism 54 having a first end in sliding engagement with the conduit 46 and a second end pivotally attached to the nozzle 52 allows for the articulation of the nozzle 52. The first end of the adjustment mechanism 54 includes a gripper member 56 and a shaft 58. The shaft 58 is positioned parallel with the conduit 46, and the gripper member 56 is slidingly attached to both the conduit 46 and the shaft 58. The second end of the adjustment mechanism 54 includes a support arm 60 and a nozzle holder 62. The support arm 60 is affixed to the gripper member 56 and moves in the same direction as the sliding movement of the gripper member 56. The nozzle holder 62 is mounted to the end of the flexible tube 50 adjacent the nozzle 52 and is pivotally connected to the support arm 58 at pivot point P1. An optical sight 63 such as a visible laser is mounted to the end of the wand 36 adjacent the nozzle 52, the optical sight 63 is optionally attached to either the flexible tube 50 or the nozzle holder 62. The optical sight is aligned with the direction of the output of nozzle 52 and articulates with the nozzle 52 upon movement of the adjuster mechanism 54. The optical sight 63 is used as a targeting device to indicate the aim of the nozzle 52. The optical sight 63 allows the user of the wand 36 to accurately aim the wet steam mixture even when the nozzle 52 has been rotated by both the rotational joint 48 and articulated by the adjustment mechanism 54 as the user is provided with the visible indication of where the nozzle 52 will direct the wet steam mixture.

Figure 3A:
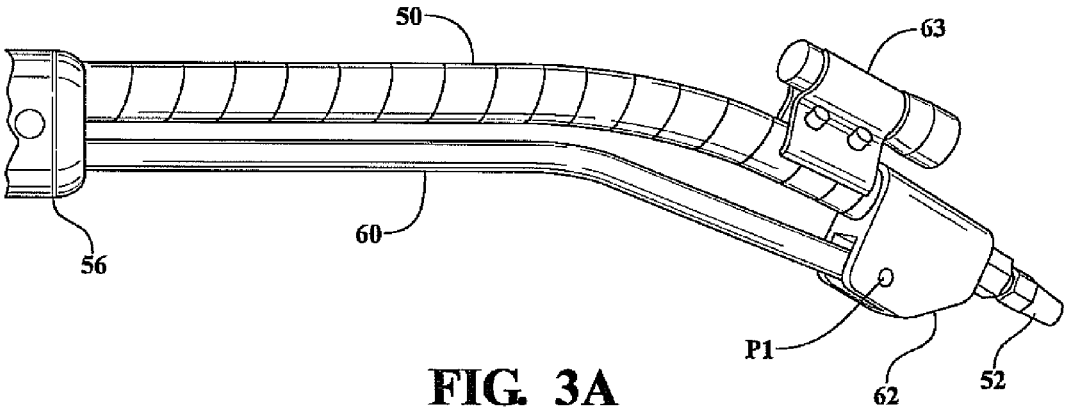
FIG. 3A is a partial side view illustrating the wand.
Figure 3B:
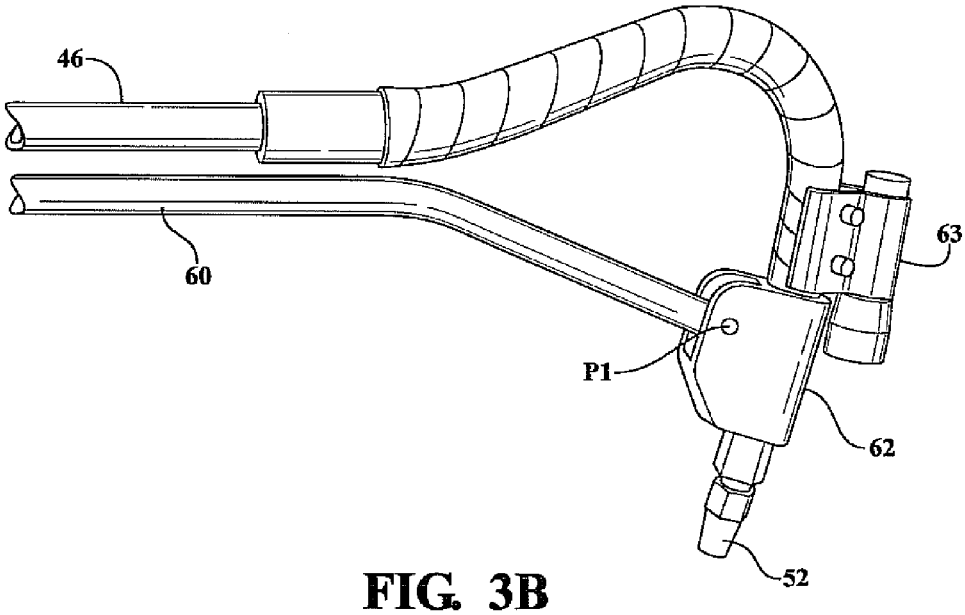
FIG. 3B is a partial side view illustrating the wand having a nozzle articulated.

As seen in FIGS. 3A and 3B, the adjuster mechanism 54 in conjunction with the flexible tube 50 allows the angle of the nozzle 52 to be selectively positioned with respect to the longitudinal direction of the conduit 46. Upon movement of the gripper member 56 along the shaft 58, the gripper member 56 pulls or pushes the support arm 60 in a corresponding direction. The movement of the support arm 60 pushes or pulls the nozzle holder 62 bending the flexible tube 50. As the nozzle holder 62 is attached to the arm 60 about pivot axis P1, the nozzle holder 62 pivots upon movement of the support arm 60 thereby varying the angle of the nozzle 52 with respect to the longitudinal direction of the conduit 46. The illustrated embodiment of the wand 36 allows for articulation of the nozzle 52 through 110 degrees, although this is for the purpose of illustration and is to be considered nonlimiting.

Figure 4:
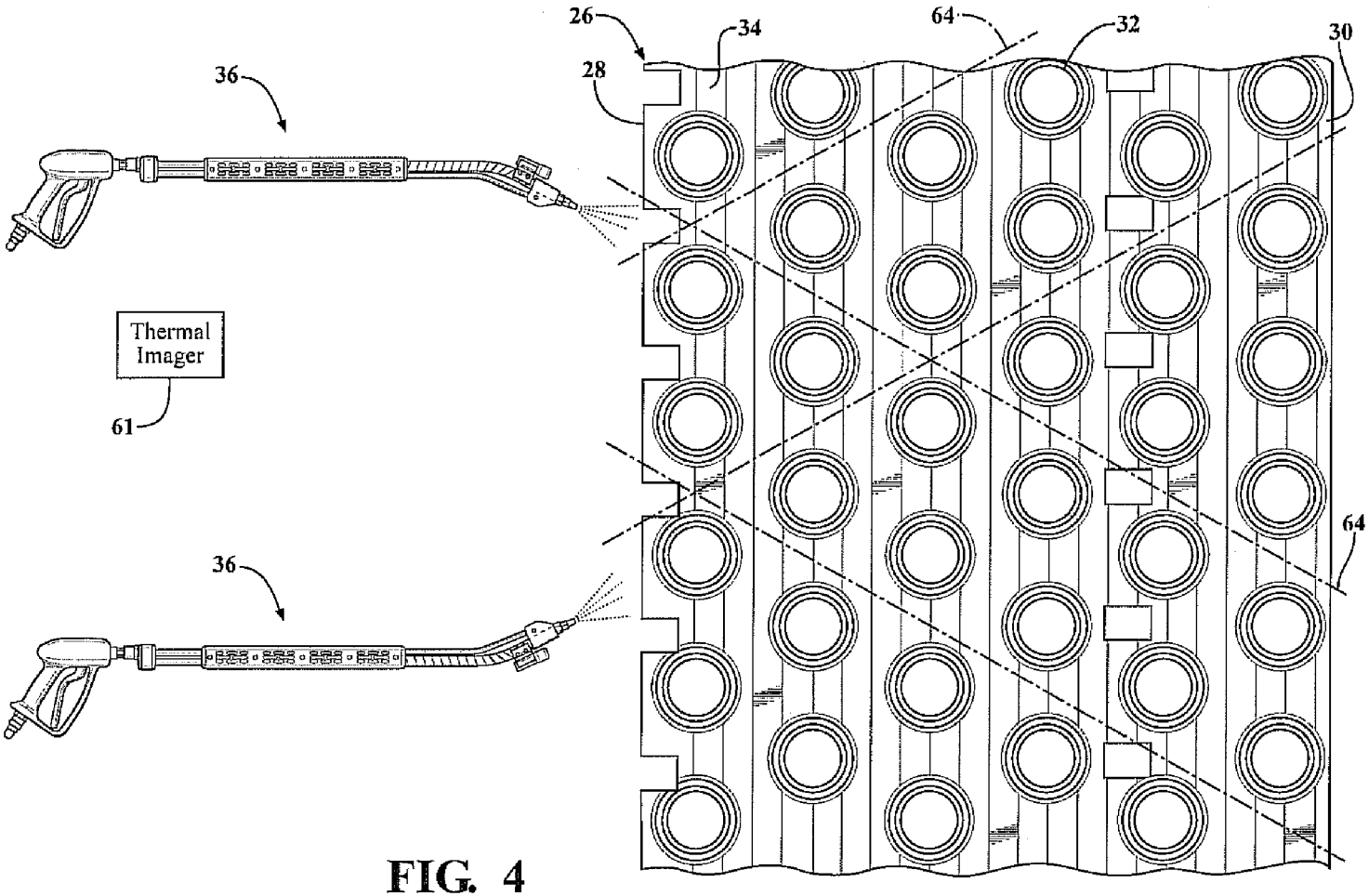
FIG. 4 is a cross-sectional view illustrating the high density coil matrix having a portion of the heat exchanging fins removed to illustrate the heat exchanging coils.

Referring now to FIG. 4, a cross-sectional view of the heat exchanger 26 having a high density coil matrix is illustrated. The heat exchanger 26 includes a plurality of rows of heat exchanging coils 32 in order to allow greater air flow around each individual heat exchanging coils 32 through which the refrigerant flows through to transfer heat between the refrigerant (i.e. coils 32) and the air directed over the coils 32 by either the condenser fan 20 or the evaporator fan 22. Each row of coils 32 are offset to the adjacent rows of coils 32 to increase the distance between each individual coil 32 thereby providing greater air flow and consequently heat transfer. The offset nature of the rows of coils 32 is the reason why previous cleaning methods were only able to clean the outer coils as water applied through a power washer in a direction perpendicular to the face (either the inlet side 28 or the outlet side 30) directed between every other row of coils 32 would impact the intermediate row of coils 32 thereby preventing penetration of the inner area of the coil matrix.

The various rows of heat exchanging coils 32 define channels 64 (depicted along line 64) which extend through the plurality of rows of coils between the inlet side 28 and the outlet side 30 of the heat exchanger 26. By directing the pressurized and heated mixture of cleaning solution and water supplied by the power steam unit 38 through each channel 64 in both an up and down orientation, the wet steam mixture is capable of penetrating the coil matrix between the inlet side 28 and the outlet side 30. Further, by directing the wet steam mixture through the channels 64, which extend in both an upwardly and downwardly direction, the coils 32 are essentially crisscrossed as both the top side and bottom side are cleaned. The wand 36 is particularly advantageous in this manner as the nozzle 52 is articulatable through various angles allowing the wet steam mixture to be directed accurately through each of the channels 64. Further still, the rotational joint 48 allows the nozzle 52 to be swiveled so as to easily direct the wet steam mixture through the both the upwardly extending and downwardly extending channels 64.

Figure 5:
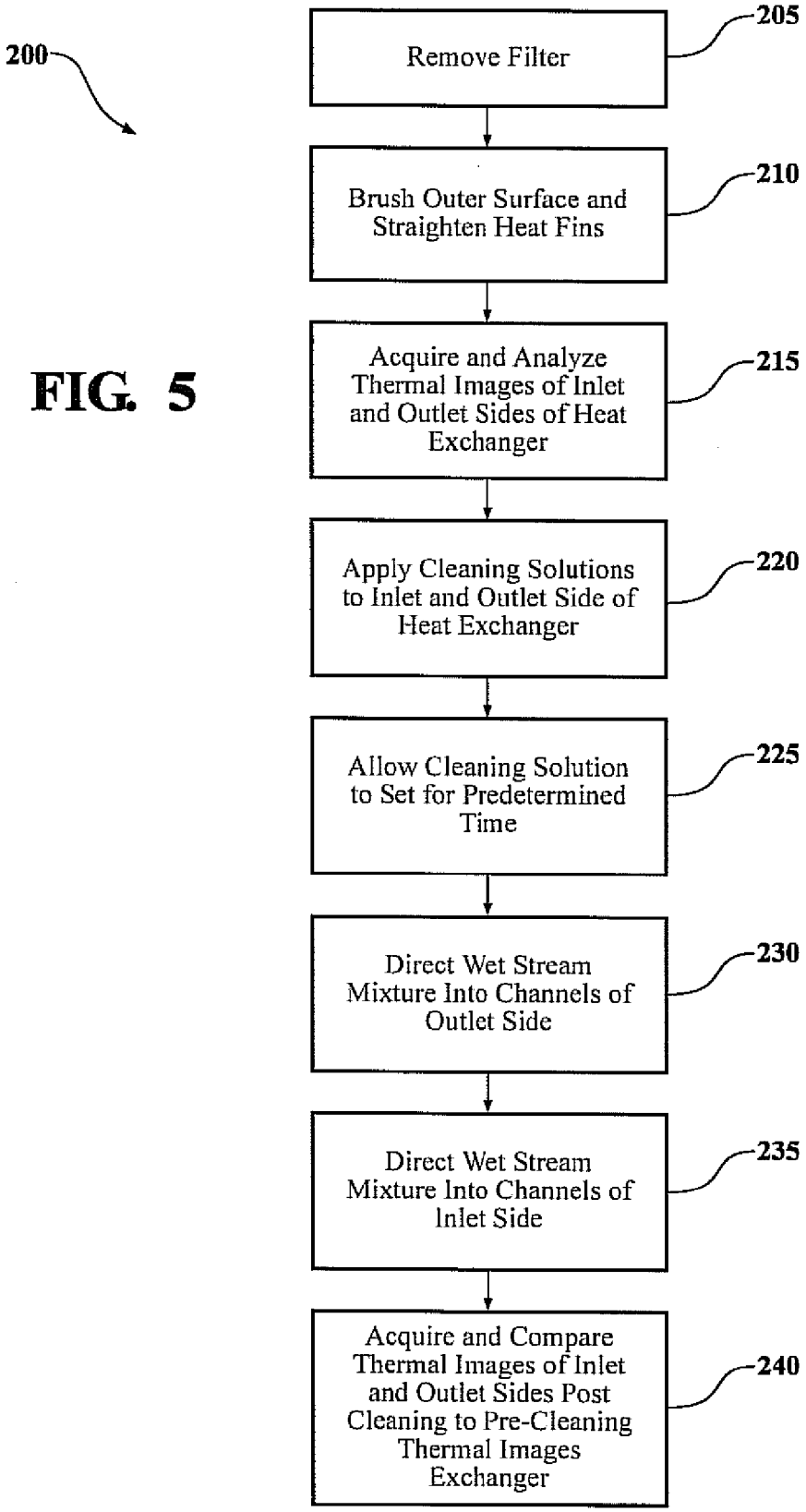
FIG. 5 is a flowchart depicting the method of cleaning a high density coil matrix heat exchanger.

With reference to FIG. 5, the method of cleaning a heat exchanger 26 having a high density coil matrix will now be discussed in conjunction with flowchart 200. The method begins at step 205 in which filters covering the inlet side 28 and the outlet side 30 of the heat exchanger 26 are removed. The method advances to step 210 in which the outer surfaces of the inlet side 28 and the outlet side including the outer most coils 32 and the heat dissipating fins 34 are scrubbed with a wire brush. Further, any fin anomalies or deformations are straightened with a fin comb which fits between the plurality of heat dispensing fins 34.

Figure 12:
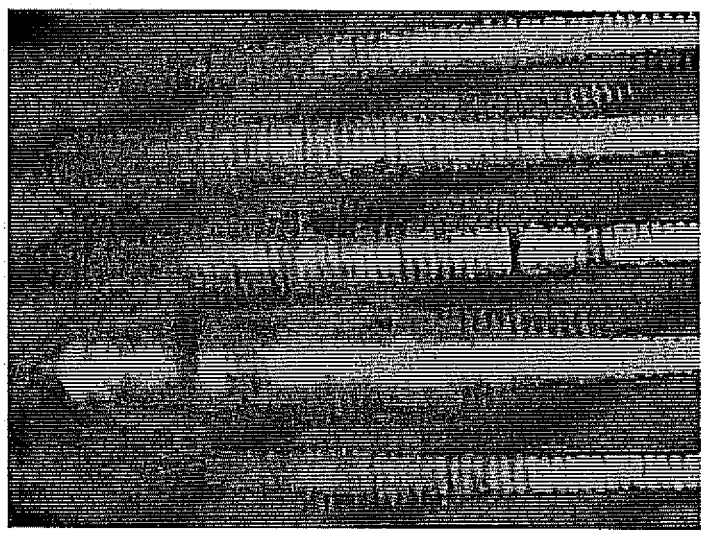
FIG. 12 is an infrared image taken of the high density coil matrix.
Figure 13:
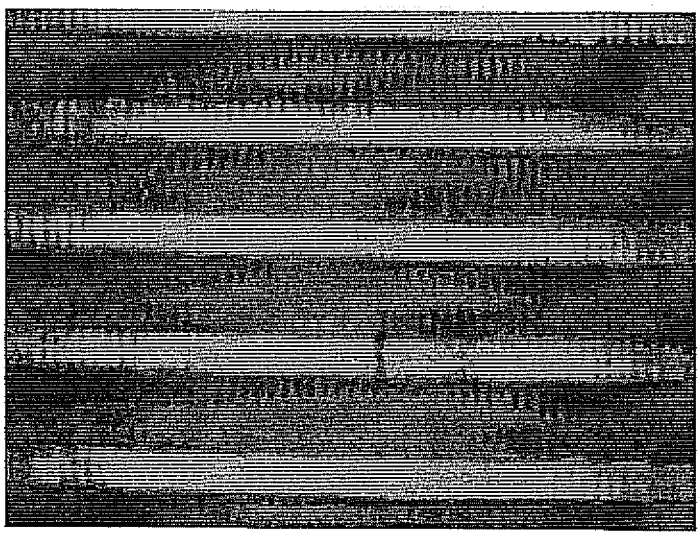
FIG. 13 is an infrared image taken of the high density coil matrix.

In step 115 a thermal images of the inlet side 28, FIG. 12, and the outlet side 30 FIG. 13, are taken by thermal imager 61, such as a FLIR camera. The thermal images are then analyzed to determine particular areas of heavy contamination illustrated by large variations in thermal characteristics. Areas having inconsistencies in the thermal output are singled out for directed applications of cleaning solution and/or wet steam.

In step 220 a cleaning solution is applied directly to the coil matrix of the heat exchanger 26. The cleaning solution is directed through all of the upwardly and downwardly extending channels 64, and on both the inlet side 28 and the outlet side 30 of the heat exchanger 26. Specifically, as the channels 64 extend across the entire width of the heat exchanger 26, a particular channel 64 is chosen and the cleaning solution is applied into the channel 64 across the width of the heat exchanger 26. The solution is then applied to adjacent and parallel channel 64 extending in the same direction. Once all of the channels 64 in the same direction have had a layer of cleaning solution applied, the solution is then applied to the channels 64 extending in the opposite direction. After completing one side of the heat exchanger 26, the process is carried out on the opposite side. It is appreciated, of course, that large scale heat exchangers 26 can be segmented into a plurality of sections, with each section receiving an application of cleaning solution through both the upwardly and downwardly extending channels 64.

The cleaning solution is a noncorrosive, environmentally friendly solvent having ammonium bifluoride, illustratively including BBJ Power Coil Clean HVAC coil cleaner, although various other noncorrosive, environmentally friendly solutions are applicable. The solution is applied in a ratio of 6 parts water to 1 part BBJ Power Coil Clean HVAC coil cleaner and is applied at 0.1 gallon per square foot. The cleaning solution is applied using a pressure sprayer allowing for the uniform distribution of the solution.

In step 225 the cleaning solution is allowed to set on the coils 32 for approximately 15 minutes. The setting time allows the cleaning solution to penetrate the contaminants formed on the surface of the heat exchanging coils 32. As the cleaning solution penetrates and soaks the contaminants which have hardened over time are loosened and begin to dissolve.

The method advances to step 230 in which the pressurized and heated wet steam mixture of cleaning solution and water is applied to the outlet side 30 of the heat exchanger 26 by the wand 36 and the power steam unit 38. As in step 220, the wet steam mixture is directed into the channels 64 so as to penetrate the coil matrix through the plurality of rows of heat exchanging coils 32 to bisect the heat exchanger 26 from the outlet side 30 to the inlet side 28. A particular channel 64 is chosen and the wet steam mixture is applied into the channel 64 across the width of the heat exchanger 26. The optic sight 63 is used to guide the user in applying the wet steam mixture at the required angle to penetrate the channels 64. The wet steam mixture is then applied to adjacent and parallel channels 64 extending in the same direction. Once all of the channels 64 in the same direction have been penetrated by the wet steam mixture, the wet steam mixture is then applied to the channels 64 extending in the opposite direction in order to crisscross each of the individual coils 32 thereby cleaning the entire surface of the coils 32.

It is appreciated, of course, that as in step 220, large scale heat exchangers 26 can be segmented into a plurality of sections, with each section receiving an application of cleaning solution through both the upwardly and downwardly extending channels 64.

The wet steam mixture is heated and pressurized by the power steam unit 38 to a temperature of at least 250 degrees Fahrenheit and a pressure of at least 1300 pounds per square inch. The wet steam mixture is applied at a rate of 1.05 minutes per square foot. The method advances to step 135 in which the application of the wet steam mixture repeated on the inlet side 28 as in step 230.

Figure 14:
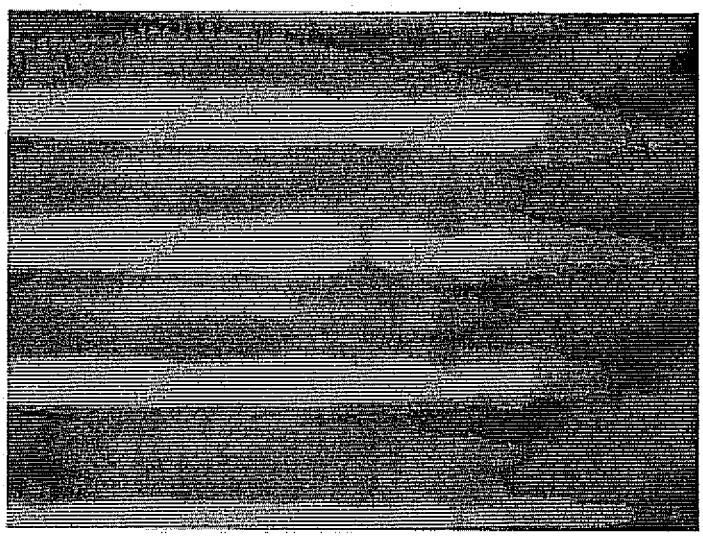
FIG. 14 is an infrared image taken of the high density coil matrix after cleaning.
Figure 15:
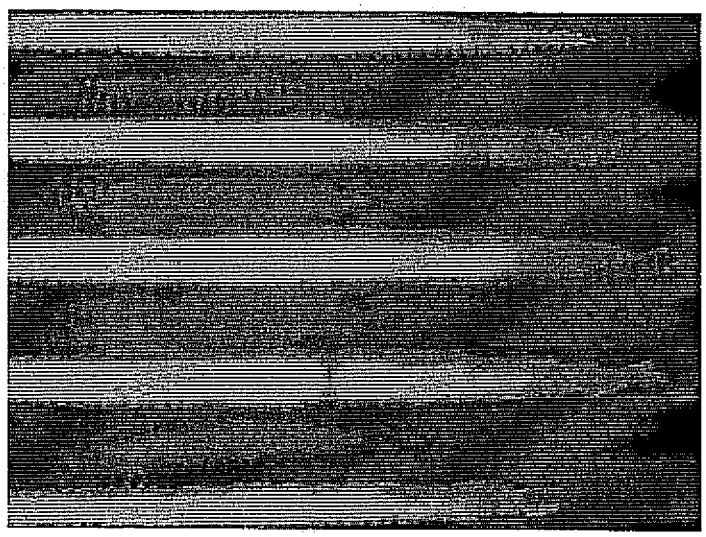
FIG. 15 is an infrared image taken of the high density coil matrix after cleaning.

In step 240, the thermal imager 61 acquires a thermal image of the inlet side 28 FIG. 14 and the outlet side 30 FIG. 15. The thermal images are analyzed to determine whether there are any areas which require additional applications of cleaning solution and/or wet steam mixture. The images are then compared to the thermal images taken prior to the cleaning process, FIGS. 12 and 13, to determine the effectiveness of the cleaning. The post cleaning thermal images of the inlet side 28 (FIG. 14) and the outlet side 30 (FIG. 15) have a more uniform thermal characteristic when compared to the pre-cleaning thermal images of the inlet side 28 (FIG. 12) and the outlet side 30 (FIG. 13). The thermal images can be used to verify the effectiveness of the cleaning process to both a technician and a consumer, and stored so as to compile a historical profile of the specific heat exchanger 26 in order to track the thermal characteristics over time and multiple cleanings.

Additionally, the condenser fan 20 and the evaporator fan 22 may be cleaned using the wet steam mixture that has been heated and pressurized. Prior to cleaning a 1 inch drain hole is drilled in the bottom of the fan housing to permit drainage of the cleaning solution. The cleaning solution is topically applied to the fan blades as above. After the solution has been applied, the steamer unit is used in the same manner as disclosed above to clean both sides of the fan blades. Any excess solution is vacuumed out of the fan housing and the drain hole is then plugged with a 1 inch plastic snap plug.

The method of cleaning the heat exchanger is particularly advantageous as the application of cleaning solution has loosened the hardened contaminant formed on the surface of the coil. The wet steam mixture is used so that the steam penetrates the loosened contaminant and the liquid washes away the contaminant. Further, as the cleaning solution is a noncorrosive and environmentally friendly solvent, no damage is done to the surface of the heat exchanging coils 32 and there is no need for rinsing the heat exchanger 26.

Figure 6:
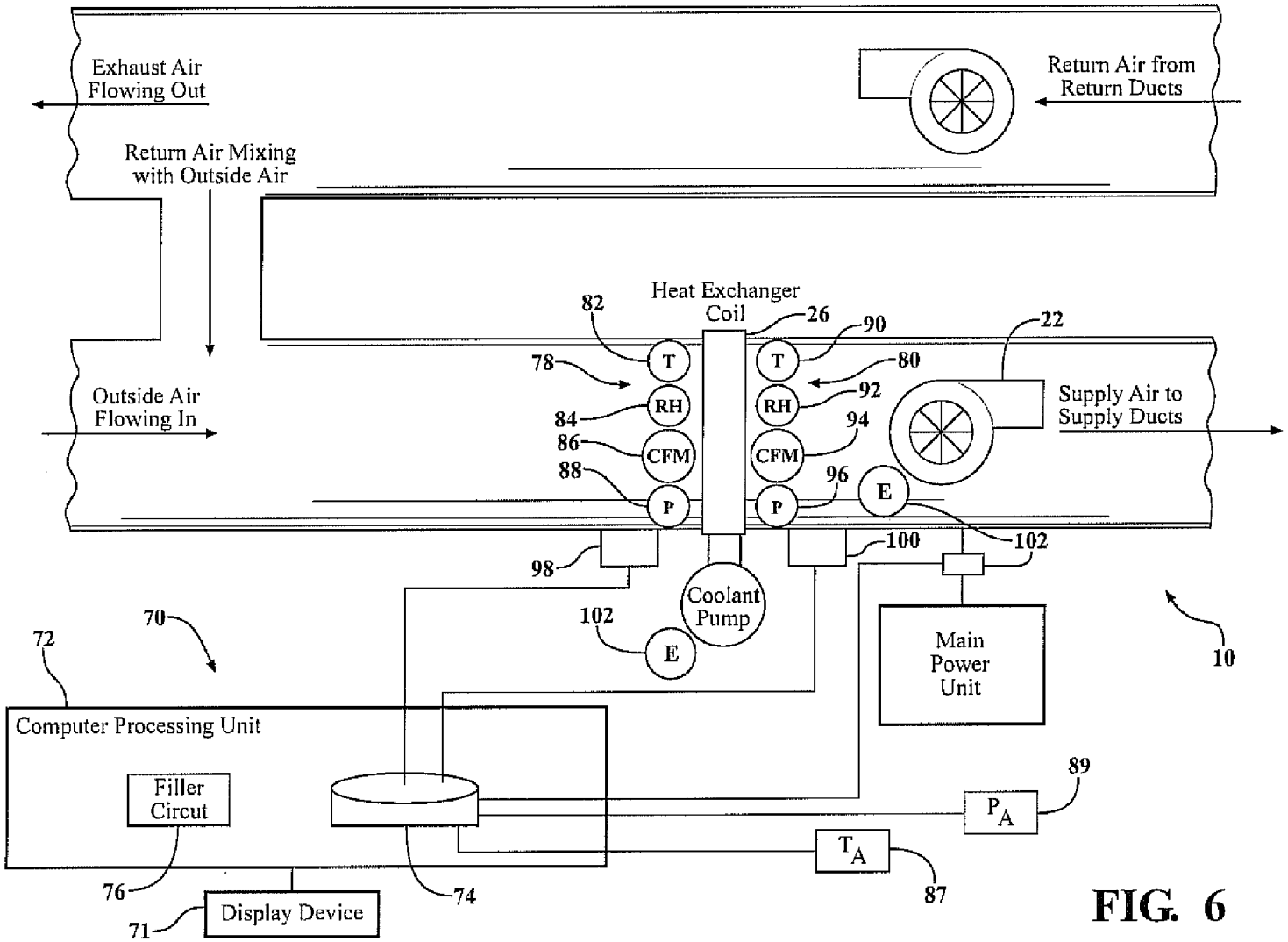
FIG. 6 is a partial schematic of an HVAC system illustrating the inventive verification system.

Referring now to FIG. 6, a system for verifying the effectiveness of cleaning a heat exchanger is generally indicated at 70. In the illustrated embodiment the heat exchanger 26 is acting as an evaporator 18, although as stated above the heat exchanger 26 is optionally the condenser 14. The system includes a computer processing unit 72 having a database 74 and a filter circuit 76. A display device 71 connected to the computer processing unit 72 acts as an input/output interface between the user and the system 70. The display device 71 optionally includes a display panel configured to display various data and a keyboard or mouse to allow the user to enter data into the system 70.

A plurality of inlet sensors 78 are positioned on the inlet side 28 of the heat exchanger 26 to measure various inlet operating conditions, and a plurality of outlet sensors 80 are positioned on the outlet side 30 of the heat exchanger 26 measure various outlet operating conditions. The inlet sensors 78 include a temperature sensor 82 (dry bulb), a relative humidity sensor 84, an air velocity sensor 86, and a pressure sensor 88. The outlet sensor 80 includes a temperature sensor 90 (dry bulb), a relative humidity sensor 92, an air velocity sensor 94, and a pressure sensor 96. In addition, a baseline temperature sensor 87 and an atmospheric pressure sensor 89 are connected to the database 74 to measure the baseline temperature and the atmospheric pressure, respectively, outside the HVAC system 10.

An electrical sensor such as a current sensor 102 is connected to the main power unit 24 so as to detect the total power usage of the HVAC system. It is appreciated, of course, that the electrical sensor 102 optionally includes a plurality of electrical sensors connected to each of the various electronic components of the HVAC system 10, such as the coolant pump connected to the heat exchanger 26 and the evaporator fan 22, if the HVAC system 10 does not include a main power unit 24.

The various inlet sensors 78 and the outlet sensors 80 are connected to a first data logger 98 and a second data logger 100. In the alternative, the temperature sensors 82 and 90, and the humidity sensors 84 and 92 are connected to the first data logger 98, and the velocity sensors 86 and 94, the pressure sensors 88 and 96, and the current sensor 102 are connected to the second data logger 100. The first data logger 98 and the second data logger 100 are connected to the database 74 of the computer processing unit 72.

During the testing period, either pre-cleaning or post cleaning, the fist data logger 98 and the second data logger 100 record all of the various operating conditions detected by the inlet sensors 78 and the outlet sensors 80 and transmit the data to the database 74 where it is stored utilizing a HOBOware software program. The HOBOware software program, run by the computer processing unit 72, collects and stores the data into separate data files, a first data file contains the data from the temperature sensors 82 and 90, and the humidity sensors 84 and 92, a second data file contains the data from the air velocity sensors 86 and 94 and the current sensor 102. The HOBOware software program synchronizes the data points by time, and performs statistical analysis in which data points outside two standard deviations from the mean are removed.

In order to provide both a technician and a consumer the ability to verify the effectiveness of the cleaning process, the system 70 calculates a Seasonal Energy Efficiency Ratio (SEER) rating for the HVAC system 10 prior to the cleaning and post cleaning. The SEER rating is the calculated efficiency of an HVAC system 10 as defined by "ANSI/AHRI 210/240-2008: 2008 Standard for Performance Rating of Unitary Air-Condition and Air-Source Heat Pump Equipment," which is herein incorporated by reference. The SEER rating is the cooling output in BTU during a typical cooling session divided by the total electric energy input in Whatt-Hours during the same period of time. A high SEER rating indicates that the HVAC system is energy efficient. Therefore, an HVAC system which has a higher SEER rating post cleaning compared to a pre-cleaning SEER rating indicates to a technician and consumer the effectiveness of the cleaning process as the energy efficiency of the HVAC system has increase which can be directly attributed to the cleaning process.

The filter circuit 76 includes ANSI/AHRI 210/240 defined operating conditions required to properly calculate the SEER rating. The filter circuit 76 filters out data which does not comply with defined operating conditions, thereby allowing the system 70 to calculate the SEER rating in accordance with the industry standards.

Figure 7:
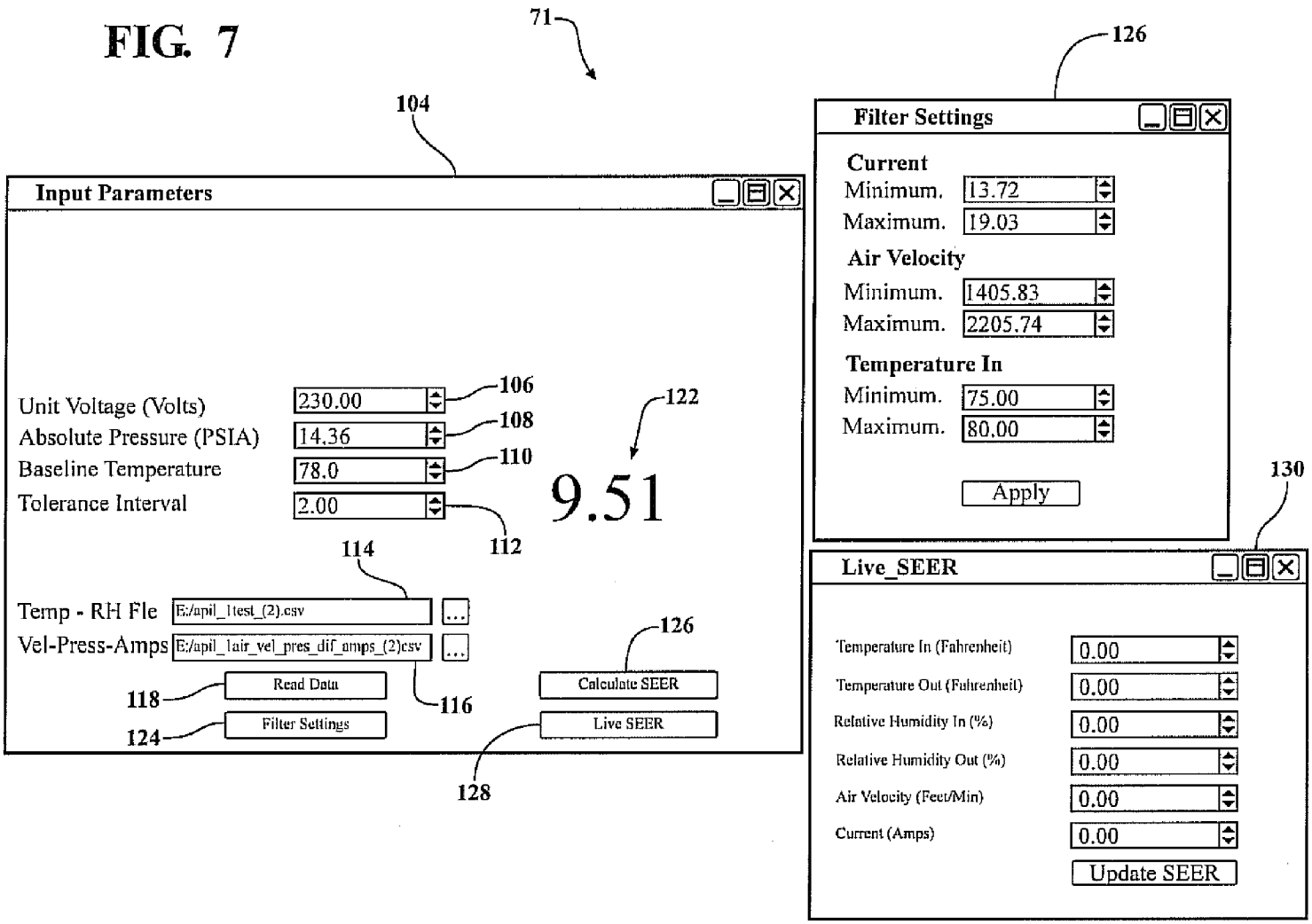
FIG. 7 is a screen shot of the system for verifying the cleaning of a heat exchanger.

With reference to FIG. 7, the display device 71 displays a Graphical User Interface allowing user control over various operating parameters of the system 70. Input parameter box 104 displays the variable parameters used in the calculation of the SEER rating. The Unit Voltage (Volts) 106 is the voltage of the HVAC system 10, typically the voltage of the main power unit 24, which is used to calculate the total power usage in conjunction with the current measured by the current sensor 102. The Absolute Pressure (PSIA) 108 is the atmospheric pressure measured by the atmospheric pressure sensor 89, and the Baseline Temperature 110 is the temperature of the environment measured by the temperature sensor 87. In the alternative, the Absolute Pressure and the Baseline temperature are inputted manually by the user. The Tolerance Interval 112 is used in the statistically analysis of the measured data and determines the amount of standard deviations from the mean in which data will be removed.

Inputs 114 and 116 direct the system 70 to the files of the database 74 in which the first data logger 98 and the second data logger 102 are stored. As data from previous SEER calculations are stored in the database 74, the user can quickly verify the effectiveness of the cleaning method over time by accessing data from previous calculations.

The Input Parameters box 104 further includes the Read Data function 118 which beings the collection of data from the first data logger 98 and the second data logger 100. The Calculate SEER function calculates the SEER rating for the HVAC system 10, as described in greater detail below, and outputs a SEER rating 122. The Filter Settings function opens the Filter Settings Box 126 which allows the user to input the various filter parameters including max and min Current, Max and Min Air Velocity, and Max and Min Inlet Temperature. The filter parameters are used by the filter circuit 76 to only calculate the SEER rating upon the satisfaction of the various conditions. The user imputable filter conditions allow the filter circuit 76 to stay current with any changes in the ANSI/AHRI 210/240 defined operating conditions and allow a technician or consumer to define the filter conditions.

The Input Parameters box 104 further includes the Live SEER function 128 which opens the Live SEER box 130 and allows a user to calculate the SEER rating while a test is in progress to offer a live view of the SEER rating. In the Live SEER box 130 the user is able to manually enter the variables while data is being collected by the first data logger 98 and the second data logger 100 in order to view a live output of the SEER rating.

The computer processing unit 72 calculates the SEER rating by determining the total amount of heat removed by the HVAC system and the total power used in removing the total amount of heat. In order to calculate the total amount of heat removed, the computer processing unit 72 calculates the various operating conditions detected by the inlet sensor 78 and the outlet sensor 80. The specific volume of dry air, the Vdryair, is calculated in accordance with the following equation:

$$Vdryair = \frac{53.352*(TDBin+459.67)*(1+1.6078*WL)}{pbarpsia*144} \quad (1)$$

where TDBin is the dry bulb temperature of the inlet side 28 of the heat exchanger 26 measured by temperature sensor 82, WL is the specific humidity of the outlet side 30 of the heat exchanger measured by the humidity sensor 92, and pbarpsia is the atmospheric pressure measured by the pressure sensor 89.

Once the specific volume of dry air has been calculated, the specific volume of the moist air can be calculated using the following equation:

$$Vmixture = \frac{Vdryair}{(1+WL)} \quad (2)$$

The constant pressure specific heat of the moist air is calculated using the following equation:

$$cpa = 0.24 + \left(\frac{(WE+WL)}{2}\right)*0.444 \quad (3)$$

where WE is the specific humidity at the inlet side 28 of the heat exchanger 26.

Once the specific volume of moist air (Vmixture) and the constant pressure specific heat (cpa) of the moist air have been calculated, the sensible capacity Qsens can be calculated using the following equation:

$$Qsens = 60 * CFM * cpa * \frac{(CoilDT)}{Vmixture} \quad (4)$$

where CFM is the volumetric flow rate of the moist air at the outlet side 30 of the heat exchanger 26 measured by the velocity sensor 94. The velocity of the air at the outlet side 30 of the heat exchanger 26 is converted into the volumetric flow rate by multiplying the velocity of the air by the area of the duct. The coilDT is the change in dry bulb temperature from the inlet side 28 to the outlet side 30 of the heat exchanger 26 measured by the temperature sensors 82 and 90.

The latent capacity (Qlat) is then calculated using the following equation:

$$Qlat = 63600 * CFM * \frac{(WE - WL)}{Vmixture} \quad (5)$$

Once the sensible capacity (Qsens) and the latent capacity (Qlat) have been computed, the total capacity is calculated using the following equation:

$$Q\text{total} = Q\text{sens} + Q\text{lat} \quad (6)$$

Next the total power of the various electronic components of the HVAC system is calculated using the following equation:

$$P\text{tot} = \text{Current} * \text{Voltage} \quad (7)$$

where Current is measured using the current sensors 102 and the Voltage is the voltage inputted into the Unit Voltage 106.

Once the total capacity (Qtotal) and the total power (Ptot) have been computed, the energy efficiency ratio EER is determined using the following equation:

$$EER = \frac{Qtotal}{Ptot} \quad (8)$$

Having calculated the energy efficiency ratio, the seasonal energy efficiency ratio SEER is calculated using the following equation:

$$\text{SEER} = \text{EER} * \text{PLF}(0.5) \quad (9)$$

where PLF is the partial load factor being the industry constant of the cyclic energy efficient ratio (coefficient of performance) to the steady state energy efficiency ratio (coefficient of performance).

The SEER ratio allows a definite comparison of the effectiveness of cleaning the heat exchanger 26 as the total amount of heat removed by the HVAC system divided by the total power usage required to remove the total heat is compared pre-cleaning of the heat exchanger 26 and post cleaning of the heat exchanger 26 to determine the efficiency of the cleaning of the heat exchanger 26 and consequently the HVAC system 10.

Figure 9:
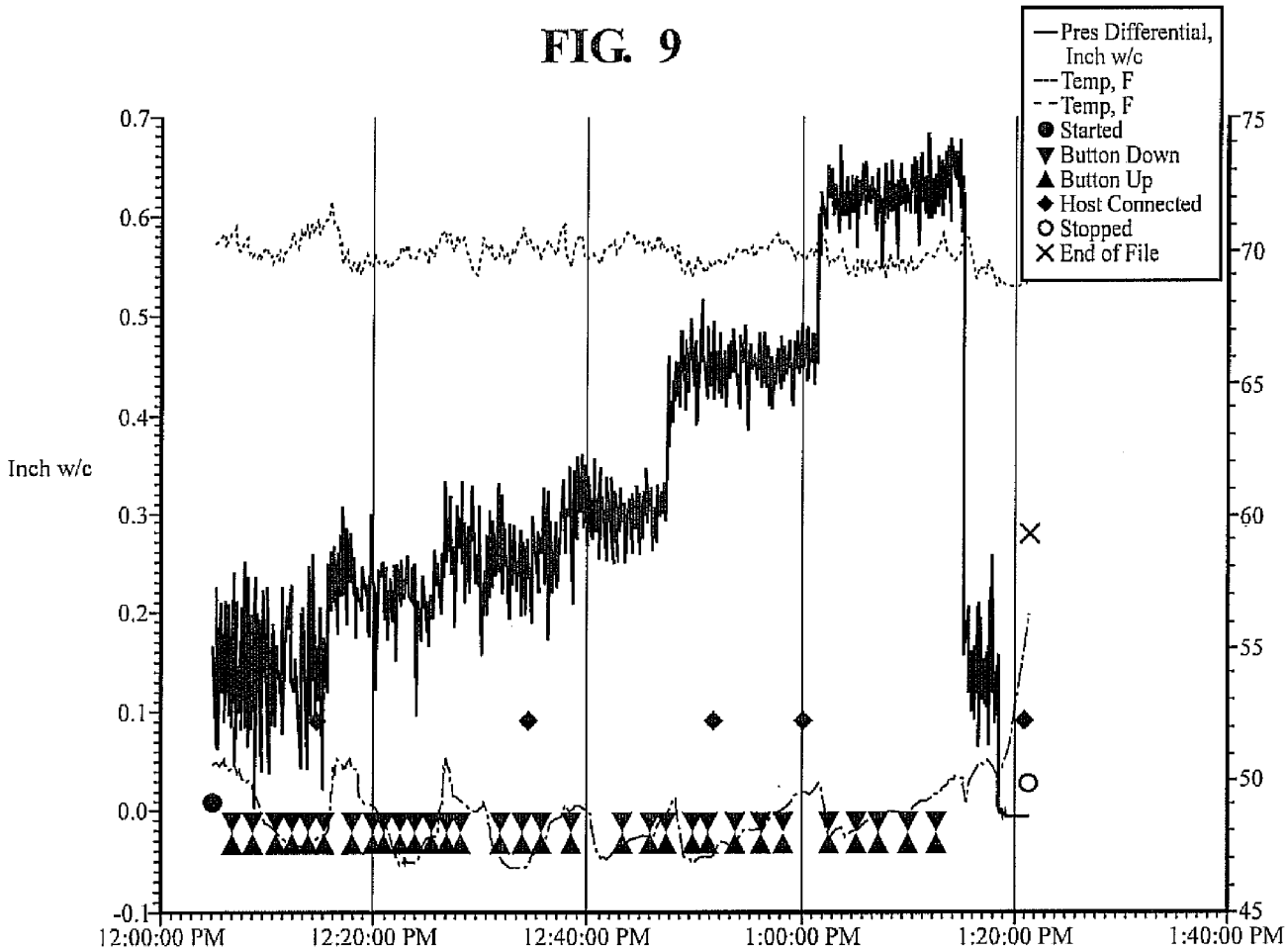
FIG. 9 is a graph illustrating depicting pressure differential and the inlet and outlet temperatures.
Figure 10:
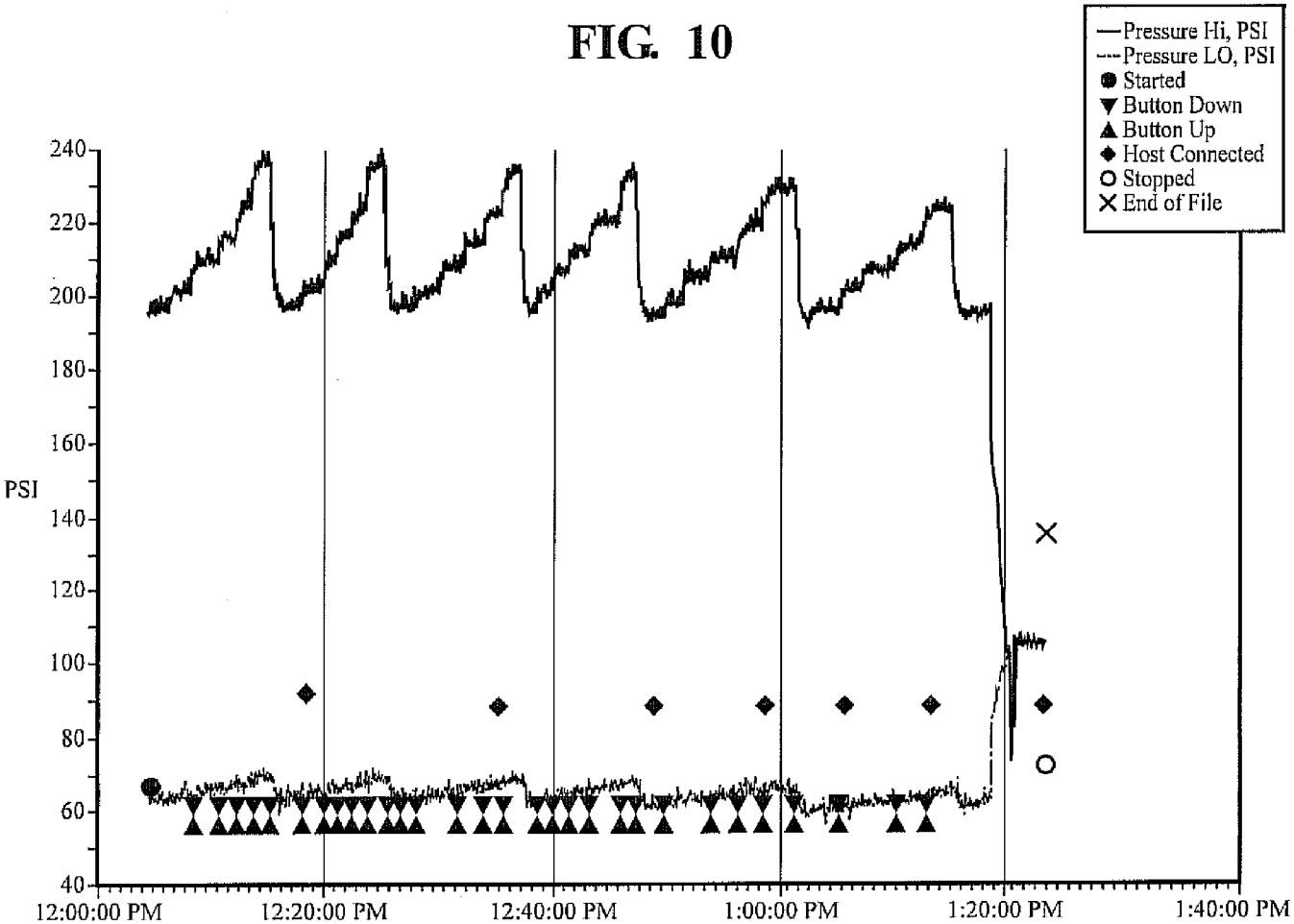
FIG. 10 is a graph illustrating the inlet pressure and outlet pressure.
Figure 11:
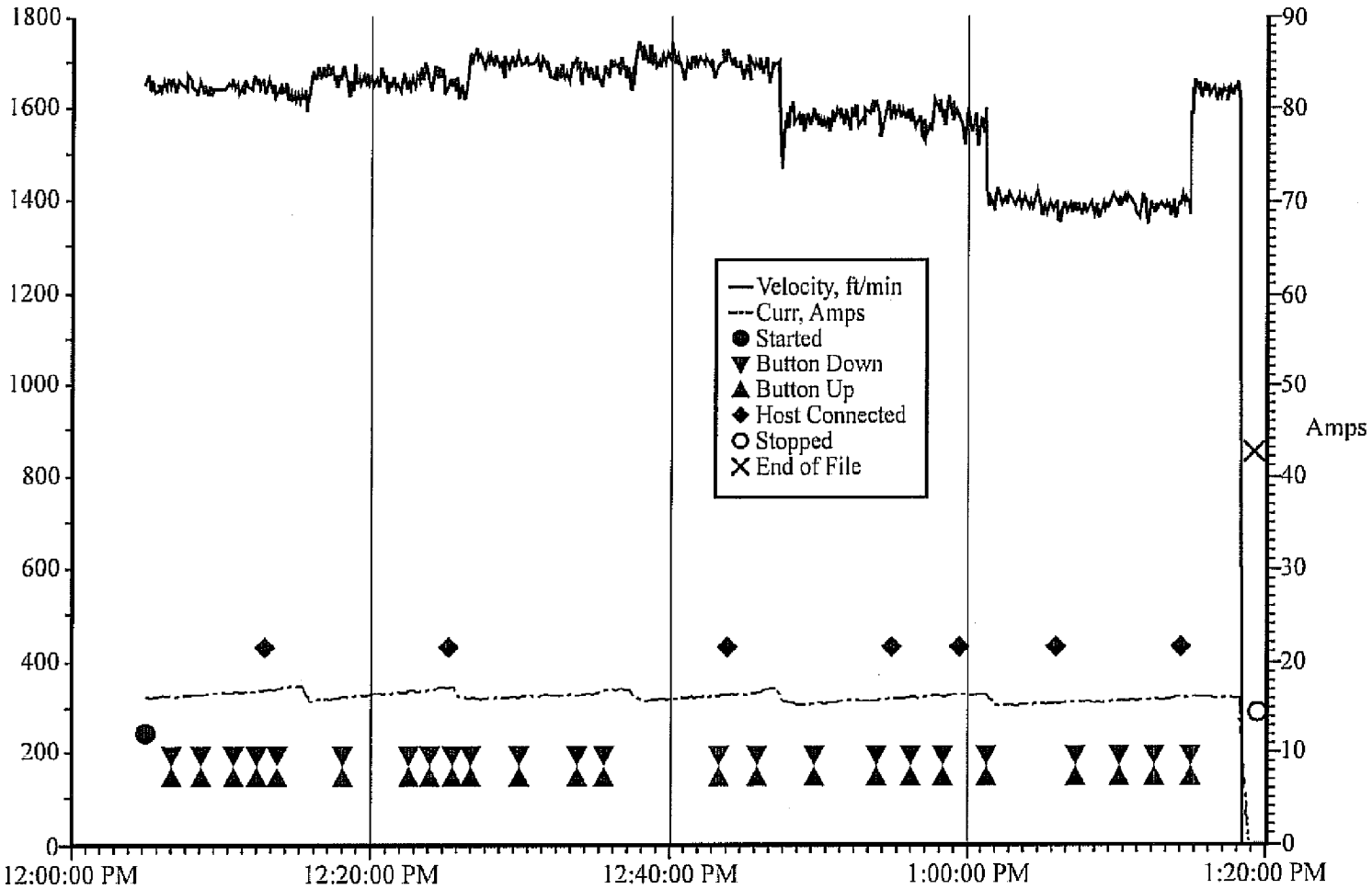
FIG. 11 is a graph illustrating the air velocity and current.

In addition to calculating the SEER rating, the system 70 compares the pre-cleaning and post cleaning measurements of the inlet sensors 78 and the outlet sensors 80 and compiles reports including graphs depicting the change in operating parameters during the testing run. FIG. 9 illustrates the graphical depiction of the pressure differential, measured by pressure sensors 88 and 96 between the inlet side 28 and the outlet side 30 of the heat exchanger. Further, FIG. 9 illustrates the temperatures of both the inlet side 28 and the outlet side 30 as measured by the temperature sensors 82 and 90. FIG. 10 illustrates the inlet side 28 pressure measured by pressure sensor 88 and the outlet side 30 pressure measures by pressure sensor 96. FIG. 11 illustrates the velocity of air at the outlet side 30 of the heat exchanger 26 as measured by the velocity sensor 94 and the current used by the HVAC system as measured by the current sensor 102. The graphs are complied from data measured both pre-cleaning and post cleaning to show both a technician and the consumer the change in operating parameters due to the cleaning process and consequently the effectiveness of the cleaning process. The graphs depicted in FIGS. 9-11 are for illustrative purposes and are not to be considered limiting as the system 70 is configured to compile graphs depicting the change of any of the measured operating parameters including the inlet side 28 temperature, humidity, velocity, and pressure, the outlet side 30 temperature, humidity, velocity, and pressure, and the current used by the HVAC system 10.

It is appreciated, of course, that the system 70 is either a portable system utilizing a laptop computer and non-permanent sensors or a permanent system in which the system 70 is built into the HVAC system 10 using permanently placed sensors. Further, the system 70 is configured to connect to a communication network, such as the internet, to transmit data during extended periods of testing, such as days, months or years. In such a configuration, the system 70 is continuously measuring and calculating data and will provide an alert when the energy efficiency HVAC system 10 falls below a predetermined SEER rating. The alert is transmitted to the technician or consumer in the form of a displayed alert on the display device 71, or an email. The system 70 is also optionally connected to a remote computer system which is monitored by a HVAC system cleaning contractor who will notify the technician or the consumer that the HVAC system 10 requires a cleaning if the energy efficiency as calculated by the SEER rating falls below a predetermined point.

Figure 8:
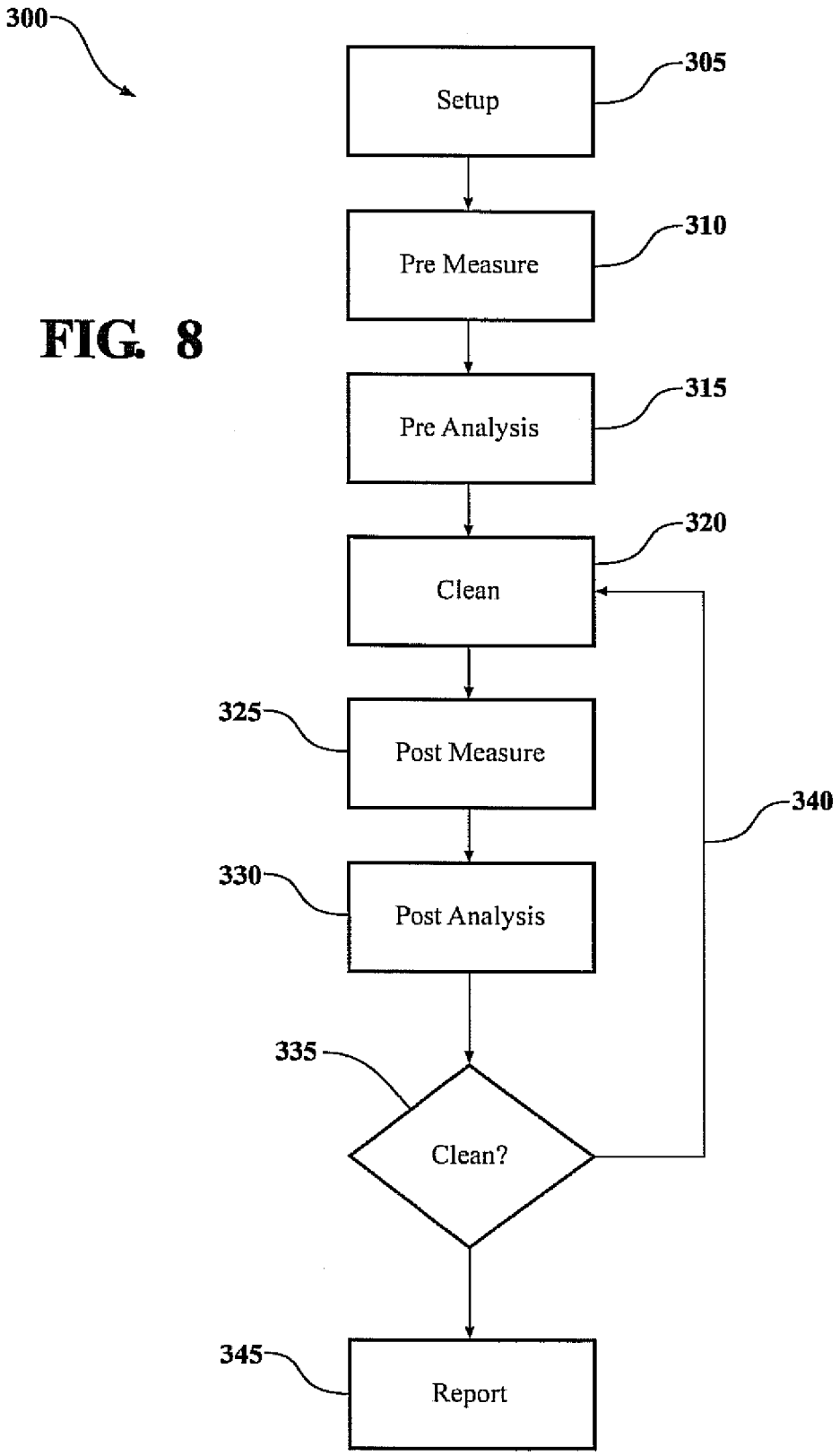
FIG. 8 flowchart depicting the method for verifying the cleaning of a heat exchanger.

In order to facilitate a better understanding of the method of verifying the effectiveness of the cleaning method, will now be described in conjunction with the flowchart 300 of FIG. 8. The method begins with step 305 in which the system 70 is connected to the HVAC system 10. The step includes the positioning of the atmospheric inlet sensors 78, the atmospheric outlet sensors 80, the current sensor 102, and optionally the atmospheric pressure sensor 89 and the baseline temperature sensor 87. The various sensors are connected to the first data logger 98 and the second data logger 100 which are then connected to the computer processing unit 72. The input parameters including the Unit Voltage 106, Absolute Pressure 108, Baseline Temperature 110, and the Tolerance Interval 112 are entered into the Input Parameters box 104 on the display device 71. In the alternative, the atmospheric pressure sensor 89 and the baseline temperature sensor 87 are connected to the system 70 so that the user does not have to manually enter the atmospheric pressure or the baseline temperature sensor. The filter parameters are then entered into the Filter Settings box 126. As discussed above, the filter parameters are optionally the ANSI/AHRI 210/240 defined parameters or technician or consumer determined filter parameters.

The method advances to step 310, in which operating parameters of pre-cleaning or "Dirty" HVAC system 10 are measured. The operating parameters include the total current of the HVAC system 10, temperature, pressure, velocity, humidity at both the inlet side 28 and the outlet side 30 of the heat exchanger 26. The operating parameters are measured for a predetermined period of time running from several minutes to several days. In addition, a thermal image of the heat exchanger 26 is acquired by the thermal imager 61 in order to identify specific areas of heavy contamination.

The method advances to step 315 where the pre-cleaning SEER rating for the HVAC system 10 is calculated by determining the total amount of heat removed by the HVAC system and the total power usage of the HVAC system 10 using the measured operating parameters and the above described equations. In addition, graphs depicting the measured data of the various operating parameters are compiled.

The method advances to step 320 in which the heat exchanger 26 of the HVAC system 10 is cleaned using the above described cleaning method.

The method advances to step 325 in which operating parameters of cleaned HVAC system 10 are measured. The operating parameters include the total current of the HVAC system 10, temperature, pressure, velocity, humidity at both the inlet side 28 and the outlet side 30 of the heat exchanger 26. The operating parameters are measured for a predetermined period of time running from several minutes to several days. In addition, a thermal image of the heat exchanger 26 post cleaning is acquired by the thermal imager 61.

The method advances to step 330 where the cleaned SEER rating for the HVAC system 10 is calculated by determining the total amount of heat removed by the HVAC system and the total power usage of the HVAC system 10 using the measured operating parameters and the above described equations. In addition, graphs depicting the measured data of the various operating parameters are compiled.

The method advances to decision box 335 where the pre-cleaning SEER rating and the post cleaning SEER rating are compared. Further, the pre-cleaning thermal image and the post cleaning thermal image are compared to determine if the heavily contaminated areas have been properly cleaned. The pre-cleaning measurements and the post cleaning measurements are also compared to determine the effectiveness of the heat exchanger 26 cleaning. The changes in the operating parameters from pre-cleaning to post cleaning provide verification of the effectiveness of the cleaning. Graphs depicting the various operating parameters pre-cleaning and post cleaning are compiled and utilized in the comparison.

A determination of the effectiveness of the cleaning is made and if the SEER rating and the operating parameters of the cleaned heat exchanger 26 has not been affected by a predetermined amount, the method follows path 340 to step 320 where the heat exchanger 26 undergoes an additional cleaning. If the SEER rating and the operating parameters have improved by a predetermined amount, the method advances to step 345 where a report detailing the change in the SEER rating and the various operating parameters is compiled. The report, including the pre-cleaning and post cleaning SEER ratings, operating parameters, and thermal images are stored on the database 74 of the system 70 to track the changes of the SEER rating and the various operating parameters over several subsequent cleanings. In addition, the report is used to create a unique operating profile for the specific HVAC system 10 which can be compared similar makes and models to assess current operating efficiency.

Having described our invention, however, many modifications thereto will become apparent to those skilled in the art to which it pertains without deviation from the spirit of the invention as defined by the scope of the appended claims.

The invention claimed is:

1. A method of cleaning a heat exchanger of an HVAC system, the heat exchanger having a coil matrix having a plurality of fins and a plurality of rows of heat exchanging coils supported by the fins, the coils spaced apart to define channels extending through the plurality of rows between an inlet side and an outlet side of the coil matrix, said method comprising the steps of:

1) a pre clean measuring step including taking thermal images of the inlet side and the outlet side and measuring pre cleaning operating conditions at the inlet side and the outlet side with a plurality of inlet sensors on the inlet side and a plurality of outlet sensors on the outlet side, wherein the plurality of inlet sensors include a temperature sensor, a relative humidity sensor, and a pressure sensor, and the plurality of outlet sensors include a temperature sensor, a relative humidity sensor, and a pressure sensor;
2) mixing water and a cleaning solution having ammonium bifluoride together to form a mixture;
3) applying a layer of the mixture directly onto the fins and outer surface of the matrix coil, said cleaning solution being noncorrosive;
4) allowing the mixture to set on the coils for a predetermined time that is sufficient so that contaminants formed on a surface of the heat exchanging coils are loosened and begin to dissolve;
5) heating and pressurizing water and the cleaning solution forming a wet steam mixture;
6) directing the wet steam mixture with a wand at exterior edges of the fins and into each of the plurality of channels as to penetrate the coil matrix between the inlet side and the outlet side; and
7) a post clean measuring step including measuring post cleaning operating conditions at the inlet side and the outlet side of the heat exchanger with the plurality of inlet sensors and the plurality of outlet sensors.

2. The method of claim 1, wherein said layer of the mixture is directed into each of the plurality of channels so as to penetrate the coil matrix between the inlet side and the outlet side.

3. The method of claim 1, wherein the wet steam mixture is heated to at least 250 degrees Fahrenheit.

4. The method of claim 1, wherein the wet steam mixture is pressurized to at least 1300 pounds per square inch.

5. The method of claim 1, wherein the wet steam mixture is applied to the outlet side of the coil matrix prior to the inlet side of the coil matrix.

6. The method of claim 1, wherein the method includes a step of articulating an angle of the wand so that the wet steam mixture is directed accurately through the channels extending through the plurality of rows between the inlet side and the outlet side of the coil matrix.

7. The method of claim 6, wherein the wand includes a rotational joint and the method includes a step of articulating the rotational joint so that the angle of the wet steam mixture varied and the wet stream mixture is directed through the channels.

8. The method of claim 7, wherein the wand includes an optic sight and the method includes a step of directing an angle of the rotational joint by guiding rotation of the rotational joint with the optic sight so that the wet steam mixture is at an angle to penetrate the channels.

9. The method of claim 1, wherein the post clean measuring step includes taking thermal images of the inlet side and the outlet side.

10. The method of claim 1, wherein steps 2 through 6 are repeated to clean the HVAC system a second time after the post clean measuring step, and wherein the predetermined amount of time is approximately 15 minutes.

11. The method of claim 1, wherein the wet steam mixture is a mixture of liquid and steam at a saturation temperature.

12. The method of claim 1, wherein the wet steam mixture is heated to at least 250 degrees Fahrenheit and is pressurized to at least 1300 pounds per square inch; wherein steps 2 through 6 are repeated after the post clean measuring step.

13. The method of claim 12, wherein the method includes a step of cleaning a condenser fan of the HVAC system, and wherein the method includes a step of articulating a rotational joint of the wand and directing an angle of the rotational joint by directing the angle of the rotational joint with an optic sight so that the wet stream mixture is directed at an angle to penetrate the channels extending through the plurality of rows between an inlet side and an outlet side of the coil matrix.

14. The method of claim 1, wherein the method includes a step of connecting an electrical sensor to a main power unit of the HVAC system so that a total power usage of the HVAC system is determined.

* * * * *